United States Patent [19]

Bäck et al.

[11] Patent Number: 4,512,803

[45] Date of Patent: Apr. 23, 1985

[54] PROCESS FOR RECOVERING LEAD FROM LEAD CHLORIDE CONTAINING RAW MATERIAL

[75] Inventors: Erik G. Bäck, Helsingborg; Björn-Eric Lundin, Huddinge, both of Sweden

[73] Assignee: Boliden Aktiebolag, Stockholm, Sweden

[21] Appl. No.: 569,657

[22] Filed: Jan. 10, 1984

[30] Foreign Application Priority Data

Feb. 2, 1983 [SE] Sweden ..... 8300536

[51] Int. Cl.[3] ..... C22B 13/00

[52] U.S. Cl. ..... 75/77

[58] Field of Search ..... 75/77

[56] References Cited

FOREIGN PATENT DOCUMENTS 2365636 4/1978 France .

WO80/00852 5/1980 PCT Int'l Appl. .

OTHER PUBLICATIONS

Gmelins Handbuch der Anorganischen Chemie 47:C:1, 1969, p. 307.

*Primary Examiner*—M. J. Andrews

*Attorney, Agent, or Firm*—Burns, Doane, Swecker & Mathis

[57] ABSTRACT

The invention relates to a method for recovering lead from lead chloride raw materials, by reducing the lead chloride with gas in a reaction zone comprising one or more separate reaction chambers. The invention is characterized in that two reduction processes are carried out simultaneously in the reaction zone, namely a reduction of solid or liquid lead chloride and a reduction of gaseous lead chloride. Non-reacted lead-chloride reactants in either of the two reduction processes are caused to take part as a reactant in the other process. The reduction gas is taken from the upper part (2) of the reaction zone (1) and the temperature of the upper part (2) of the reaction zone (1) is lower than the lower part (4) of the reaction zone.

16 Claims, 3 Drawing Figures

PROCESS FOR RECOVERING LEAD FROM LEAD CHLORIDE CONTAINING RAW MATERIAL

Figure 1:
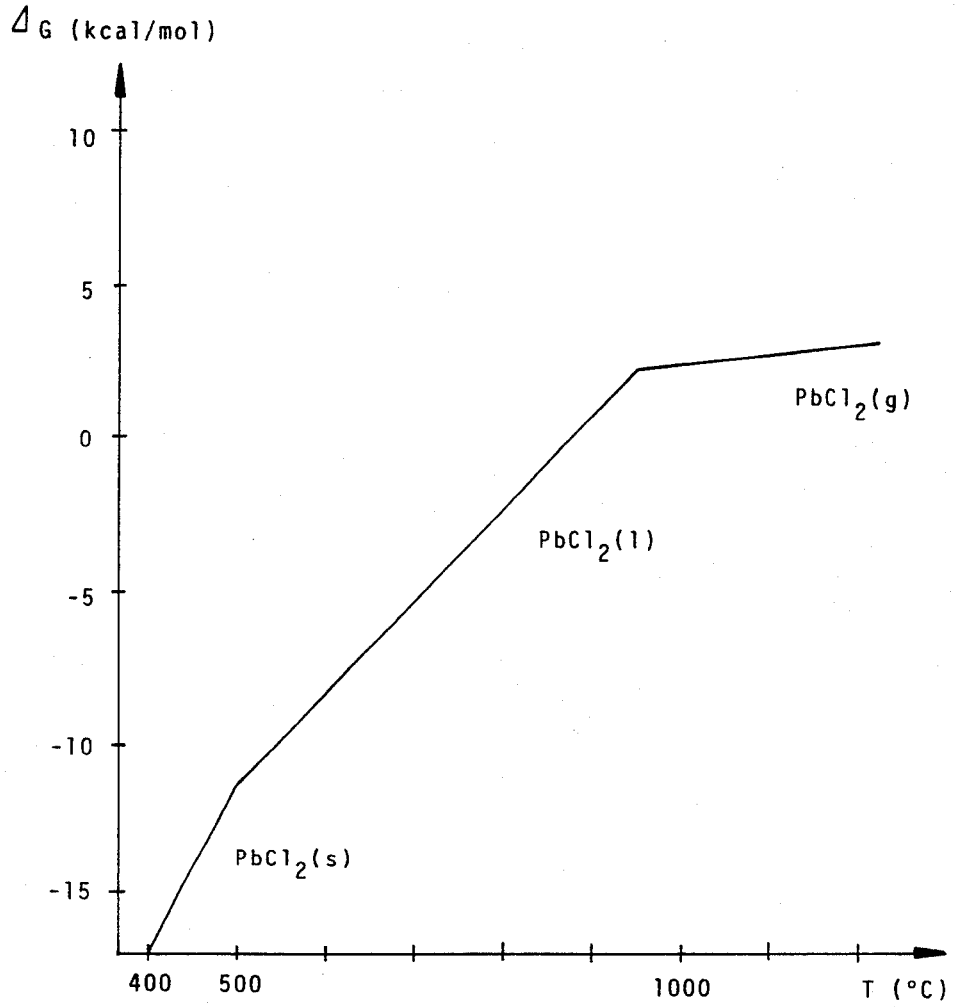

Since time immemorial lead has primarily been produced by subjecting lead ores to pyrometallurgical treatment processes. The pyrometallurgical treatment of lead chloride raw materials is still today the most common method of producing lead, and normally incorporates a sintering process followed by reduction and smelting processes in shaft furnaces. Even though present day pyrometallurgical processes can be considered well developed from a purely technical aspect, they still leave much to be desired with respect to emission levels, energy consumption and economy. In an attempt to produce lead economically while, at the same time, satisfying the high demands placed on the care and protection of the environment, a number of manufacturers and institutions have investigated and proposed the use of hydrometallurgical processes. In general, the proposed processes involve leaching lead sulphide in a chloride environment, while oxidising the sulphide at the same time. The resultant leaching solution is then cleansed from impurities, the lead chloride remaining in the solution in a dissolved form. Although the lead chloride can be reduced to metal directly, by electrolysing the solution, the lead obtained thereby is porous and has poor electrode-adhesion properties, and hence the lead-metal product cannot be readily removed from the electrolysis cell.

According to one proposed method for reducing lead chloride, the lead chloride is crystallised out from the cleansed solution, and then subjected to a smelt electrolysis, whereupon lead metal and chlorine gas are formed. This method, however, is not sufficiently economic and does not therefore afford a practical solution to the problem of working-up lead chloride.

In No. FR-A1-7416773 and No. FR-A2-7628910 it is proposed to reduce lead chloride with hydrogen gas, by blowing the hydrogen gas from below through a layer of molten lead having superimposed thereon a layer of molten lead chloride. The reaction gas containing hydrogen gas and hydrogen chloride, together with vapourised lead chloride, is combusted above the lead-chloride smelt, in order to afford the process the necessary heat boost. A serious problem with this method, however, is that it is difficult to recover the vapourised part of the chloride. This vapourised part of the chloride can represent a substantial part of the ingoing chloride, even at temperatures close to the melting point of lead chloride. Consequently, the process yield is comparatively low.

In Boliden's earlier patent specification No. SE-A-7810670-5 there is proposed a process in which basically a liquid lead chloride is brought into counter-flow contact in a column reactor with a stream of reducing gas, and non-reduced lead chloride is re-cycled from the lower part of the reactor to the upper part thereof. It is possible when applying this process to substantially improve the process yield of lead-chloride reduction, by supplying an excess quantity of lead chloride to the system and re-cycling surplus chloride. This re-cycling of the chloride, however, causes heat to be transferred from the lower part of the reactor to the upper part thereof, which contributes to vapourisation of lead chloride in the upper part of the reactor, thereby increasing the risk of losing the lead chloride in the exiting reaction gas. It is true that the reaction gas can be cooled so as to condense out lead chloride, but in practice this would create apparatus problems.

It has now been surprisingly found that a technically attractive process for recovering lead from lead chloride can be obtained through a combination of counter-flow reduction of solid or liquid lead chloride and a simultaneous gas-gas reduction process. Among other things, this eliminates the need of recycling nonreacted lead chloride in the process, and thus, also overcomes the problem associated with the circulation of heat between the upper and lower parts of the reaction zone. Thus, the method according to the invention utilizes the vapourisation of lead chloride in the reaction zone, something which is undesirable in the earlier processes described in the introduction, to enable complete conversion of the chloride, while, at the same time, facilitating supply of the energy required to carry out the reduction. The invention is characterised by those process steps set forth in the following claims. In the following, reference will primarily be made to hydrogen as the gas used to reduce the lead chloride. Even though gaseous hydrogen is preferred, however, it will be understood that other gases and mixtures of gases can be used, for example, cracked ammonia without departing from the basic concept of the invention.

The reduction of lead chloride with hydrogen gas takes place in accordance with one of the reactions:

$$PbCl_2(l)+H_2(g) \rightleftarrows Pb(l)+2HCl(g) \quad (1)$$

$$PbCl_2(g)+H_2(g) \rightleftarrows Pb(l)+2HCl(g) \quad (2)$$

Lead chloride melts at about 500° C. and has a boiling point at atmospheric pressure of about 954° C. Its vapour pressure in the solid phase is given by the relationship Log P(mm Hg) $= -9890\ T^{-1} - 0.95\ T - 0.91 \log T + 15.36$, where T is degrees Kelvin. Thus, the vapour pressure at melting point is in the order of $10^{-2}$ mm Hg. Lead metal melts at 327.5° C. and boils immediately above 1700° C. at atmospheric pressure. The equilibrium conditions for the reactions can be seen from FIG. 1, where ΔG in kcal/mol for the reduction of lead chloride in liquid phase and in gas phase with hydrogen is given as a function of the temperature in degrees Centigrade.

The following thermodynamic relationship applies for reaction (1)

$$\Delta G = 40\,060 + 16.18\ T \log T - 83.74\ T,$$

where T is degrees Kelvin.

The following relationship applies for reaction (2)

$$\Delta G = -5740 - 14.33\ T \log T + 47.48\ T$$

Corresponding thermodynamic relationships also apply to ammonia when the reducing component is hydrogen, but existing in atomic, optionally nascent, form and are thus probably more reactive.

The method according to the invention can be carried out in several ways within the scope of the main claim. Two proposed main variants, however, are set forth in the depending claims. Thus, within the scope of the main claim, the method can be carried out substantially as a counter-flow reduction of liquid lead chloride, substantially all said lead chloride being supplied to the colder part of the reaction zone. In accordance with this embodiment, the lower part of the reaction zone is maintained at such a high temperature that substantially all the non-reacted liquid lead chloride reaching said part of said zone is released and is able to accompany the reaction gas up again through the reaction zone. In this way there is effected firstly a parallel-flow gas-gas reduction in accordance with formula (2), and secondly cooling of non-reacted lead-chloride vapour to condense the vapour to a liquid phase. This liquid phase will then be reduced in accordance with formula (1) essentially in counterflow with the gas, and so on. The non-reacted lead chloride will be constantly circulated internally with the reaction zone, in a manner such that the non-reacted liquid chloride, subsequent to being heated and vapourised, will be reduced in parallel-flow, and non-reacted lead-chloride gas will be reduced in counter-flow, subsequent to cooling and condensing the gas.

According to the other main variant of the invention, the major part of the reduction process is carried out in a lead-chloride smelt and/or gas phase. In accordance with this variant, the major part of the lead chloride is introduced to the warmer, lower part of the reaction zone, suitably in a manner such that heat is thereby supplied to the reaction zone through the chloride. Gas for the reduction process and optionally for heating the zone is also introduced to said lower part of the reaction zone. Pre-heated liquid chloride is suitably introduced to a sump or a container, intended for lead and lead chloride, arranged in the lower part of the zone. The reduction gas is brought into contact with the liquid lead chloride, either by introducing the gas through the chloride layer or against or along the upper surface thereof. In this way, metallic lead is formed from the chloride in accordance with reaction (1), to an extent influenced by the temperature and the contact variables of time, geometry, and area, said lead being collected in the sump. The amount of lead chloride accompanying the gas is dependent upon approximately the same variables as those mentioned above, and during its movement up towards the colder part of the reaction zone will be subjected to a gas reduction process in accordance with reaction (2), and will be cooled and subsequently condensed. Condensation of the lead vapour can be facilitated by contacting the gas with solid or liquid chloride, for example by passing the gas through a bed of solid chloride particles or in counter-flow to liquid-chloride rain. The amount of lead chloride contained in the reaction gas will be progressively reduced in this way; the lead content of the gas can also be reduced by cooling said gas.

This cooling process can also be suitably carried out through the influence of solid lead chloride introduced to the upper part of the reaction zone. By combining the processes of contact condensation and cooling, the lead chloride content of the reaction gas can be lowered to negligible values, and consequently when the reaction gas leaves the reaction zone, the gas need not be cleansed with respect to lead chloride. As beforementioned, the heat required to carry out the endothermic reduction reactions and for vapourising the lead chloride can be obtained by pre-heating reactants and/or other materials, for example, carrier gas, and introducing said reactants and/or gas to the lower part of the reaction zone. Heat can also be supplied to the lower part of said zone directly, either electrically or by some other heating means. The lower part of the reduction zone is suitably maintained at a temperature of 900°–950° C., when a lead-chloride smelt is to be maintained in the bottom of the zone, but may be higher in those embodiments when such a smelt is not desired or not anticipated. In such cases, it may be necessary, or desirable, to maintain a temperature of up to 1100°–1200° C., and even higher temperatures, to obtain rapid, complete conversion to lead. In order to eliminate chloride losses through the departing gas, the temperature of the exiting gas should be beneath 500° C., preferably beneath 400° C. At temperatures beneath 400° C. the amount of gaseous chloride accompanying the gas can be considered negligible in the present context, even when considerable quantities of gas leave the system.

Figure 2:
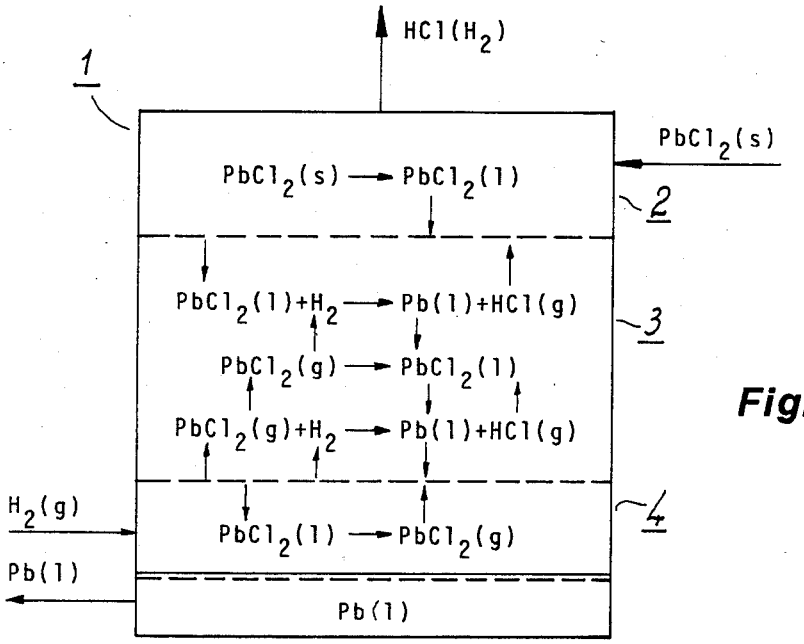
Figure 3:
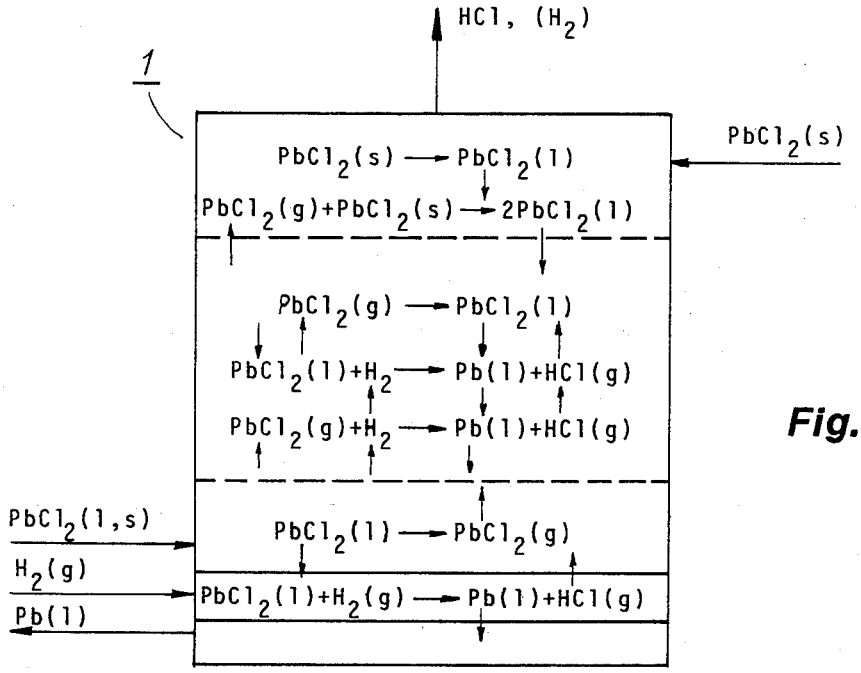

The invention will now be described more clearly with reference to the accompanying drawings, in which FIG. 1 illustrates the thermodynamical conditions for the method when reducing with hydrogen;

FIG. 2 illustrates a preferred first embodiment for the reduction of lead chloride in accordance with the invention; and FIG. 3 illustrates a preferred second embodiment of the invention.

In FIGS. 2 and 3 there is graphically illustrated a reaction zone which is identified generally by the reference 1. The reaction zone is divided into an upper part 2, an intermediate part 3, and a lower part 4. Apparatus-wise the parts 2, 3 and 4 can be separate from one another and thus constitute different units, for example, the upper part 2 may comprise a pre-heater or heat-exchanger, the intermediate part 3, a vertical column reactor, for example such as that described in our earlier Patent No. SE-A-7810670-5, and the lower part a separate, heatable melting unit. The whole of the reaction zone 1, however, may advantageously comprise a single reactor in which the said parts are separated from one another, for example by perforated partition plates or the like. In this respect the intermediate part 3 may suitably have the form of a shaft filled with packing bodies, while the upper part 2 may have the form of a hollow shaft which is held filled with a column of solid lead chloride. In certain embodiments it may be an advantage to arrange the part 4 of the reaction zone separately from the other parts of said zone, for example in the form of a furnace, while the said parts 2 and 3 form a single unit. The size of the various parts of the reaction zone is adjusted in prevailing local wishes and conditions, for example with respect to the temperature pattern in the reaction zone, choice of reduction gas, exiting gas, composition and distribution of the lead chloride charged between the lower and the upper part of the reaction zone. The height of part 2 of the reaction zone can be varied in dependence upon the extent to which the gas is to be cooled, the composition of said gas and the amount of solid liquid chloride charged to said zone. FIG. 2 illustrates the preferred embodiment of the invention, in which all, or substantially all of the lead chloride is charged to the upper part 2 of the reaction zone 1. The essential reactions in each part of the reaction zone have been indicated, as has also the directions taken by the reactants and products respectively, these latter directions being indicated by upwardly and downwardly directed arrows. As indicated by an arrow referenced $PbCl_2(s)$, solid lead chloride is introduced to the part 2 of the reaction zone 1. The chloride is suitably charged with the aid of a screw feeder or some other gas-tight conveying means. The chloride is heated in the upper part 2 of the reaction zone by upwardly flowing gas, mainly hydrogen chloride and optionally carrier gases supplied to the system, together with any surplus hydrogen gas. (In this embodiment hydrogen gas is assumed to be the reduction gas). Naturally it is conceivable that a minor quantity of chloride will already have been reduced in part 2 of the reaction zone by any surplus hydrogen gas present. In this way, solid lead chloride is melted and liquid chloride caused to fall to the intermediate part 3, or to be transported thereto by some other means. Liquid lead chloride arriving from the upper part 2 of the reaction zone is reduced in a counter-flow reaction process during its movement down through said intermediate part 3. The lead formed will accompany the liquid chloride downwardly through the zone. Gaseous lead chloride accompanying the gas, for example chloride vapourised in the lower part 4 of zone 1, will contact the downwardly moving droplets of lead chloride and lead in the intermediate part 3 of said reaction zone, whereupon some of the gaseous chloride will condense and the resultant lead-chloride condensate will accompany lead chloride and lead down to the bottom part 4 of the zone 1. Non-condensed gaseous lead chloride will be reduced by the reaction gas which has served to carry said gaseous lead chloride upwards, thereby to form liquid in the vicinity of the border line between the parts 3 and 4 of the reaction zone.

As will be understood, the closer that any remaining non-reacted droplets of lead chloride approach the bottom part 4 of the reaction zone 1, the hotter they will become and the greater the extent to which said droplets are vapourised to form lead-chloride vapour, which in turn will accompany the reduction gas up to and into the intermediate part 3 of the reaction zone for further reduction reaction and condensation. Thus, lead chloride will be subjected to a certain amount of circulatory processing between the various parts of the reaction zone 1 and within said parts, at least between said parts 3 and 4 and within said part 3. The lead formed is collected at the bottom of the reaction zone 1, and is removed therefrom in the manner indicated by the arrow Pb(l).

FIG. 3 illustrates a second preferred embodiment of the invention, in which at least the major part of the lead chloride is introduced to the lower part 4 of the reaction zone 1. The reaction taking place in the different parts of the zone and the directions taken by reactants and products have been indicated in the same manner as FIG. 2. Molten or solid lead chloride is charged to the zone part 4, which is arranged to heat and/or to melt the chloride. Liquid lead chloride will form a molten layer above the bath of molten lead collected from the reaction zone 1. Hydrogen gas is charged to the lower part 4 of the reaction zone, for example by blowing said gas through the chloride-smelt layer or against the surface thereof. The gas can also be introduced substantially horizontally immediately above the surface of the bath. As shown by the reaction formula in the $PbCl_2$(l)-layer, liquid lead chloride is reduced in this way. The reduction gas which is also heated when contacting the smelt will contribute, together with the formed reaction gas (hydrogen chlorine), in vapourising lead chlorine from the molten bath and in transporting the lead-chloride vapour upwardly towards the intermediate part 3 of the reaction zone 1. During its passage up towards and into the intermediate zone part 3, the lead-chloride vapour is reduced in parallel flow. The non-reduced vapour can be caused to condense mainly in the intermediate zone part 3, by cooling the gas and by the presence of condensation nucleants. Any residual quantities can be caused to condense in the zone part 2. For the purpose of effecting such cooling and condensation, a minor part of the lead chloride can be charged to the upper zone part 2 in an unheated state, whereupon during the heating and melting process this chloride will function as a coolant and condensation nucleate for the gas. The gas cooling and condensating process can, of course, also be effected by other cooling methods, for example by externally cooling the upper part 2 of the reaction zone 1. In this respect, the amount of lead chloride charged to the upper part 2 is adapted in accordance with the desired temperature of the exhiting process gas.

As above indicated, the method according to the invention can be modified in many ways within the scope of the concept of the invention, although a common feature of all embodiments is the absence of external recycling of non-reacted lead chloride, and that vapourisation in the lower part 4 of the reaction zone 1 is carried out to such an extent that the amount of any lead chloride present is held substantially constant.

We claim:

1. A method for recovering lead from lead chloride by reducing the lead chloride with a reducing gas in a reaction zone, said method comprising:

(a) introducing a major portion of the lead chloride in liquid or solid form into a lower part of the reaction zone;

(b) heating the lead chloride whereby a bath of liquid lead chloride is present and a portion of the liquid lead chloride is vaporized;

(c) introducing the reducing gas in a lower part of the reaction zone;

(d) contacting the liquid and vaporized lead chloride with the reducing gas whereby liquid lead chloride is reduced to liquid lead and vaporized lead chloride flows upward through the reaction zone with the remainder of the reducing gas and is reduced or condensed;

(e) introducing the remainder of the lead chloride into an upper part of the reaction zone thereby cooling said part of the reaction zone;

(f) contacting the lead chloride introduced into the upper part of the reaction zone with the upwardly flowing reducing gas;

(g) removing a gaseous effluent from the upper part of the reaction zone; and (h) removing lead from the reaction zone, wherein the method is operated in the absence of an external recycle of liquid lead chloride and such that the upper part of the reaction zone is maintained at a lower temperature than the lower part of the reaction zone.

2. The method of claim 1 wherein the non-reduced upwardly flowing vaporized lead chloride is contacted with the lead chloride introduced into the upper part of the reaction zone and is condensed to liquid lead chloride.

3. The method of claim 1 or 2 wherein the lower part of the reaction zone is a separate reaction chamber.

4. The method of claim 3 wherein the separate reaction chamber is a heatable furnace chamber.

5. The method of claim 1 wherein the temperature of the gaseous effluent is less than 500° C.

6. The method of claim 1 wherein the temperature of the gaseous effluent is less than 400° C.

7. The method of claim 1 wherein the reaction zone is a vertical reactor vessel arranged for collecting the lead formed and the liquid lead chloride present.

8. The method of claim 1 wherein at least some of the lead chloride introduced into the lower part of the reaction zone is preheated.

9. The method of claim 1 wherein the reaction zone is heated.

10. The method of claim 1 wherein the intermediate part of the reaction zone is maintained at a temperature between 900° C. and 950° C.

11. A method of recovering lead from lead chloride by reducing the lead chloride with a reducing gas in a reaction zone, said method comprising:

(a) introducing a major portion of the lead chloride in liquid or solid form into an upper part of the reaction zone;

(b) introducing the reducing gas in a lower part of the reaction zone;

(c) contacting the major portion of the lead chloride and the reducing gas in countercurrent flow such that a portion of the lead chloride is reduced;

(d) maintaining the temperature of a lower part of the reaction zone at a temperature such that non-reduced liquid lead chloride therein is vaporized and flows upwardly with the reducing gas;

(e) removing a gaseous effluent from the upper part of the reaction zone; and (f) removing lead from the reaction zone, wherein the method is operated in the absence of an external recycle of liquid lead chloride and such that the upper part of the reaction zone is maintained at a lower temperature than the lower part of the reaction zone.

12. The method of claim 11 wherein the temperature of the gaseous effluent is less than 500° C.

13. The method of claim 11 wherein the temperature of the gaseous effluent is less than 400° C.

14. The method of claim 11 wherein the reaction zone is a vertical reactor vessel arranged for collecting the lead formed and the liquid lead chloride present.

15. The method of claim 11 wherein the reaction zone is heated.

16. The method of claim 11 wherein an intermediate part of the reaction zone is maintained at a temperature between 900° C. and 950° C.

* * * * *